United States Patent [19]

Tommaney

[11] Patent Number: 4,615,730

[45] Date of Patent: Oct. 7, 1986

[54] METHOD FOR REFINING MOLTEN METAL BATH TO CONTROL NITROGEN

[75] Inventor: Joseph W. Tommaney, Buffalo Township, Butler County, Pa.

[73] Assignee: Allegheny Ludlum Steel Corporation, Pittsburgh, Pa.

[21] Appl. No.: 729,002

[22] Filed: Apr. 30, 1985

[51] Int. Cl.[4] ..... C21C 7/00

[52] U.S. Cl. ..... 75/51.2; 420/71

[58] Field of Search ..... 75/59, 60, 130.5

[56] References Cited

U.S. PATENT DOCUMENTS

Re. 29,584 3/1978 Heise ..... 75/60

16,082 11/1856 Bessemer ..... 75/60

3,891,429 6/1975 Cox ..... 75/60

4,260,415 4/1981 Simmons ..... 75/60

*Primary Examiner*—Peter D. Rosenberg

*Attorney, Agent, or Firm*—Patrick J. Viccaro

[57] ABSTRACT

A method for refining a molten metal bath is provided including introducing a refining gas containing substantially a combination of oxygen and nitrogen to the molten bath to reduce the carbon content of the bath to a selected level; thereafter an inert gas, such as argon, is introduced to the molten bath from a lance adapted to direct the inert gas onto or beneath the bath surface, whereby the inert gas serves to efficiently remove nitrogen from the bath.

8 Claims, No Drawings

METHOD FOR REFINING MOLTEN METAL BATH TO CONTROL NITROGEN

BACKGROUND OF THE INVENTION

This invention relates to a method for refining a molten metal bath, such as for producing steel. More particularly, the invention relates to controlling the nitrogen content of a molten metal bath refined in oxygen-type processes.

In the production of steel, for example, it is conventional practice to remove various impurities from molten metal, including decarburizing, to reduce the amount of carbon present. This is performed by introducing oxygen into a molten metal bath to produce a reaction between carbon dissolved in the molten metal bath and the oxygen to form volatile carbon oxides which are removed from the bath as gaseous reaction products. In addition to performing decarburization by the use of oxygen alone, it is known to use oxygen in combination with an inert gas. The inert gas improves the overall refining efficiency by reducing the partial pressure of CO and also serves as a means for agitating or stirring the bath. Since nitrogen is less costly than an inert gas, such as argon, it is widely used for cost reduction purposes. In decarburization practices of this general type, the gas may be introduced solely from tuyeres submerged in the bath, or from a lance directed onto or beneath the molten metal bath surface or, in addition, from tuyeres submerged in the bath. As a result of various ratios of nitrogen-to-oxygen used, the bath can become saturated with nitrogen. Also, in production facilities practicing transfer of molten metal between two or more ladles or vessels, additional nitrogen pickup occurs to the molten metal.

During this refining period, available metallic constituents from the molten steel may be oxidized to the slag. To recover metallics, such as chromium, to the metal, it is necessary to add a slag reductant, such as silicon or aluminum, for this purpose. An inert gas is generally used to stir the reductant within the bath for efficient reaction and to remove the nitrogen from the steel after the completion of decarburization, e.g., when the carbon content of the bath has been reduced to a selected level. It is known that after reduction, when the bath is deoxizided and oxygen is at a low level, nitrogen removal is more efficient. Oxygen is known to hinder the kinetics of nitrogen removal. For this purpose, an inert gas, generally argon, is introduced through tuyeres beneath the surface of the bath; however, the rate of flow of argon through tuyeres is restricted. High flow rates through tuyeres appear to increase vessel refractory wear and increase the cooling effect on the tuyeres, resulting in a buildup of "frozen metal" known to those skilled in the art as "knurdles" or "mushrooms" at the tuyere tip and decrease in efficiency. Also, during decarburization to prevent excessive nitrogen levels in the steel, an inert gas, such as argon, may be substituted for nitrogen during the blowing cycle at a specified time commonly termed the "nitrogen switch point." In view of such problems associated with removing nitrogen, it is conventional by those skilled in the art to control nitrogen by minimizing nitrogen pickup in the molten metal and not by removing nitrogen from high to acceptable levels.

U.S. Pat. No. 4,260,415, issued Apr. 7, 1981 to the Assignee of the present application, discloses, among other things, the use of argon through tuyeres to flush out or remove nitrogen from the bath to desired levels. A practice of using top-mixed gases including argon through a top lance in combination with bottom stirring action through a tuyere or plug is described in copending application Ser. No. 604,098, filed April 26, 1984, and assigned to a common Assignee.

It is, accordingly, a primary object of the present invention to provide a faster, more efficient practice for reducing the nitrogen content of the metal bath to the desired level upon the completion of the decarburization practice wherein nitrogen is substituted for an inert gas.

A more specific object of the invention is to reduce the nitrogen content of the metal bath to the desired level by the use of reduced amounts of inert gas, such as as argon.

Other more specific objects of the invention are to increase the efficiency of nitrogen removal from the metal bath and decrease the time required to supply the inert gas to the bath while minimizing wear on vessel refractory and reduce the buildup of knurdles which decrease the efficiency of decarburization.

SUMMARY OF THE INVENTION

In accordance with the present invention, a method is provided for refining a molten bath comprising introducing a refining gas containing substantially combinations of oxygen and nitrogen to the molten bath until carbon in the bath is reduced to a selected level. Introduction of the refining gas is discontinued and thereafter, the method introduces an inert gas to the molten bath from a lance adapted to direct the inert gas onto or beneath the bath to reduce the nitrogen content of the bath to desired levels.

DETAILED DESCRIPTION OF THE PREFERRED EMBODIMENTS

Broadly in the practice of the present invention, the decarburizing method thereof is performed in a conventional decarburizing vessel and the vessel may, in addition, be provided with tuyeres beneath the surface of the bath. In the conventional manner oxygen or oxygen and nitrogen in combination are introduced to the bath from the lance, tuyeres or the use of a lance and tuyeres in combination. A portion of the oxygen reacts with the carbon in the molten bath to evolve carbon oxides, which are removed in gaseous form. In accordance with the invention, at the end of the refining period wherein carbon in the bath has been reduced to a selected level, an inert gas, such as argon, is introduced to the bath from a lance that directs the gas onto or beneath the surface of the bath. Typically, a slag reductant, such as aluminum and/or silicon, is introduced with the inert gas for purposes of recovering chromium and other metallics to the bath which have been oxidized to the slag during decarburization. The oxygen level of the bath is also reduced to a low or minimum value when the reductant is added.

For purposes as used herein, the term inert gas is used to refer to any gas which is substantially nonreactive with the molten metal and includes argon, xenon, neon, helium, and mixtures thereof.

In combination with the inert gas introduced from the lance, inert gas may simultaneously be introduced through tuyeres. With the invention, since the argon is supplied from a lance, the argon supply rate is more rapid than with prior art practices wherein the inert gas is supplied solely from the tuyeres. Consequently, the nitrogen removal achieved by the introduction of the inert gas is more rapid and efficient, thereby reducing the time required to complete the overall refining operation. In addition, by introducing the inert gas from a lance as opposed to solely from tuyeres, the stirring action is such as to be less severe with respect to refractory wear. The efficiency of nitrogen removel by reducing the time required for this operation and the reduction in refractory wear, of course, serve to reduce overall the cost of the refining operation.

Furthermore, by attempting to lower the nitrogen content to desired levels after at least a portion of the slag has been reduced by the addition of the slag reductant, the nitrogen removal is more efficient. At such time the oxygen level is lower which increases the kinetics of reaction to remove nitrogen.

As required for the present invention, conventional lances may be used. Conventional lances are designed for specific flow rates and molten metal bath penetration. For purposes hereof, a regular lance designed for a flow rate of 4500 to 7000 cubic feet per minute (CFM) is suitable. On a tonnage basis, the range may be 55 to 88 CFM/ton. Another alternative would be to use a special low flow lance designed to achieve bath penetration at flow rates lower than 4500 CFM, such at 1000 to 4000 CFM. On a tonnage basis, the range may be about 12 to 50 CFM/ton.

The tuyeres or porous plugs located in the vessel beneath the molten bath surface and generally in the vessel bottom may have a total flow rate of 100 to 1500 CFM, or on a tonnage basis, a range of about 1 to 19 CFM/ton.

The total inert gas flow rate from the lance and from beneath the molten metal bath surface may range from 100 to 7000 CFM. On a tonnage basis, the total inert gas ranges from 1 to 88 CFM/ton. Actual total inert gas flow depends on numerous factors such as stir time, the type of vessel and the type of tuyeres, as active or inactive, for example.

As specific examples to demonstrate various aspects of the invention, a series of heats of the nominal composition low carbon AISI Types 402, 409, 413, and 436 stainless steel were processed in a conventional basic oxygen refining vessel (BOF) having an overhead lance and tuyeres beneath the surface of the molten metal bath. The heats were produced in approximately 80-ton batches of hot metal and high carbon chromium alloy.

TABLE I

| Heat | Type | End Blow % N | After Reduction % N | Argon Per Ton $Ft_3$ |
|---|---|---|---|---|
| 190766 | 409 | .055 | .034 | 925 |
| 190767 | 402 | .049 | .048 | 790 |
| 190768 | 409 | .048 | .044 | 948 |
| 190765 | 436 | — | — | 1214 |
| 190793 | 436 | .025 | .039 | 1305 |
| 190794 | 436 | .020 | .022 | 1294 |
| 190792 | 409 | .032 | .026 | 1091 |
| 190769 | 413 | .024 | .026 | 1014 |
| 190770 | 413 | — | .032 | 811 |
| 190572 | 436 | — | .038 | 1204 |
| 190573 | 436 | .025 | .019 | 1155 |
| 190771 | 413 | .042 | .036 | 843 |
| 190772 | 413 | .041 | .036 | 701 |
| Average | | .036 | .033 | 1023 |

The heats of Table I were made using the prior practice of "nitrogen switch points" during decarburization to prevent excessive nitrogen levels in the steel by substituting argon for nitrogen during the bottom blowing cycle.

TABLE II

| Heat | Type | End Blow % N | After Reduction % N | Argon Per Ton $Ft^3$ | Argon Stir Time Min. |
|---|---|---|---|---|---|
| 192614 | 413 | .082 | .040 | 819* | 9 |
| 192615 | 413 | .047 | .029 | 515 | 9 |
| 192619 | 413 | .074 | .042 | 600 | 8 |
| 192620 | 413 | .099 | .057 | 547 | 9 |
| 192621 | 413 | .068 | .036 | 640 | 9 |
| 192622 | 413 | .061 | .026 | 907 | 8 |
| 192623 | 413 | .048 | .030 | 952* | 7 |
| 192624 | 413 | .053 | .028 | 950* | 8 |
| 192616 | 413 | .065 | .036 | 855 | 12 |
| 192626 | 413 | .082 | .042 | 697 | 8 |
| 192627 | 413 | .082 | .041 | 942* | 9 |
| Average | | .069 | .037 | 765 | — |

*means heat was reblown.

Heats shown in Table II were produced by blowing refining gas of oxygen, nitrogen, and argon and mixtures thereof from a top lance concurrent with introduction of an inert gas from tuyeres beneath the surface of the molten metal bath, in accordance with the teachings of copending Application Ser. No. 604,098, filed Apr. 26, 1984, to achieve a desired carbon level. As a modified practice, after the end of blowing and during the reduction, argon gas flowing at a rate of 2000 cubic feet per minute (CFM) from a conventional top lance was used in conjunction with 300 CFM argon from the tuyeres to provide additional mixing or stirring of the bath and to lower the nitrogen levels. On a tonnage basis, the argon flow through the lance was on the order of 25 CFM/ton.

With reference to the Tables, the After Reduction analysis of nitrogen was taken after the argon stirring.

The data of the heats illustrate that the practice of blowing argon gas through the lance after decarburization and during the reduction period appears to reduce nitrogen levels and to reduce argon consumption.

It should also be noted from the Table that several heats, had to be reblown, i.e., again injected with refining gas to effect decarburization in order to achieve the desired carbon level or achieve a sufficiently high molten metal bath temperature, such as greater than 3100° F. (1704.5° C.) before tapping. In cases of reblowing, additional argon consumption is incurred.

The heats demonstrate the process of the present invention and were refined in a manner similar to the heats in Table I, except that the refining gas was substantially oxygen and nitrogen and mixtures thereof. The data show that the nitrogen levels after reduction are similar to those described in Table I. Argon consumption, however, is reduced considerably. The average argon consumption of 765 cubic feet per ton is a significant reduction over an average of 1023 cubic feet per ton for the heats of Table I representing the prior practice. Furthermore, for Table II, argon consumption for nonreblown heats is 642 cubic feet per ton compared to 914 cubic feet per ton for those heats reblown to achieve desired carbon levels. Such data compares favorably with AOD refined heats for Type 413 which is on the order of 400 to 500 cubic feet per ton.

As illustrated by the nitrogen and argon data of Tables I and II, the practice of the invention efficiently achieves effective nitrogen removal with an acceptable quantity of argon. Efficient inert gas consumption with regard to nitrogen removal is attributed to the practice of the invention wherein an inert gas, such as argon, is blown through a lance during the reduction period for stirring the metal bath.

An advantage of the present invention is that the inert gas can be supplied much faster for shorter times and at less consumption from a top lance without the problems associated with high gas flows through tuyeres. Also, for active tuyeres, any significant buildup of "mushrooms" or knurdles on the tuyere which adversely affect decarburization on subsequent heats is avoided. Furthermore, as the nitrogen removal is a function of the gas volume and not the time, the inert gas flow rates from a lance may be increased to high enough levels to achieve a minimal overall stirring time to achieve a desired nitrogen level without adversely affecting vessel refractory wear. Also, the present invention can eliminate the need for the nitrogen switch point in the decarburization and thereby eliminates melting errors that could result from missed switch points which would require reblows. Avoiding reblows reduces overall gas consumption and, particularly, inert gas consumption.

A further advantage is that the present invention can be used in conjunction with the prior practice of nitrogen switch points during decarburization and eliminate melting errors.

Another advantage of the present invention is that nitrogen removal may be more efficient by substantially preventing the readsorption of nitrogen in the vessel during the reduction stirring and nitrogen flushing. As the total inert gas is introduced after decarburization, less residual air would be present in the vessel than would be there in the situation where lower inert gas flow rates are used.

Although preferred and alternative embodiments have been described, it will be apparent to one skilled in the art that changes can be made therein without departing from the scope of the invention.

What is claimed is:

1. A method for refining a molten bath, the method comprising, introducing a refining gas containing substantially a combination of oxygen and nitrogen to said molten bath until carbon in said bath has been reduced to a selected level, discontinuing introduction of said refining gas to said bath having slag thereon and, thereafter, introducing an inert gas to said molten bath at a relatively high flow rate of 12 cubic feet per minute per ton or more from a lance adapted to direct said inert gas onto or beneath said bath to reduce th nitrogen content of said molten bath to desired levels, and during introduction of said inert gas from said lance, inert gas is additionally introduced to said bath at a low flow rate from beneath the surface thereof.

2. The method of claim 1 wherein said inert gas in an inert gas selected from the group consisting of argon, xenon, neon, helium, and mixtures thereof.

3. The method of claim 1 including introducing a slag reductant to said bath to reduce both the oxygen level in the bath and metal oxides, and during said slag reductant introduction, said inert gas in introduced.

4. A method for producing stainless steel from a molten bath, the method comprising:

introducing a refining gas containing substantially a combination of oxygen and nitrogen from a lance adapted to direct said oxygen and nitrogen onto or beneath said bath until carbon in said bath has been reduced to a selected level, discontinuing said introduction of said oxygen and nitrogen to said bath having slag thereon, introducing a slag reductant to said bath to recover metallics from the slag to said bath and to reduce the oxygen content, and during at least a portion of said slag reductant introduction, introducing an inert gas at a relatively high flow rate of 12 cubic feet per minute per ton or more from a lance adapted to direct said inert gas onto or beneath said bath, and continuing said introduction of inert gas until nitrogen present in said bath has been reduced to a selected level.

5. The method of claim 4 wherein during introduction of inert gas from said lance, inert gas is additionally introduced to said bath at a low flow rate from beneath the surface thereof.

6. The method of claim 5 including introducing inert gas from beneath the bath surface at a flow rate of about 19 cubic feet per minute per ton or less.

7. The method of claim 4 wherein said inert gas is an inert gas selected from the group consisting of argon, xenon, neon, helium, and mixtures thereof.

8. In a method for refining a molten metal bath in the production of steel, the method including introducing a refining gas consisting essentially of oxygen and nitrogen and mixtures thereof to said molten bath to decarburize said molten bath to desired carbon content and discontinuing introduction of said refining gas to said bath having slag thereon, wherein the improvement comprises:

after discontinuing said refining gas, introducing a slag reductant to recover chromium and other metallics to said bath from the slag and to reduce the oxygen content of said bath, and during a portion of said slag reductant introduction, thereafter introducing an inert gas selected from the group consisting of argon, xenon, neon, helium, and mixtures thereof to said molten bath from a lance adapted to direct said inert gas at relatively high flow rates of 12 cubic feet per minute per ton or more onto or beneath said bath to reduce the nitrogen content of said bath, and during introduction of said inert gas from said lance, inert gas is additionally introduced to said bath at a low flow rate from beneath the surface thereof.

* * * * *